US006036109A

United States Patent [19]

DeYoung

[11] Patent Number: 6,036,109

[45] Date of Patent: Mar. 14, 2000

[54] INDEXING AIRCAP RETAINING RING

[75] Inventor: Roger L. DeYoung, Nolensville, Tenn.

[73] Assignee: Campbell Hausfeld/Scott Fetzer Company, Harrison, Ohio

[21] Appl. No.: 09/240,808

[22] Filed: Feb. 1, 1999

[51] Int. Cl.[7] ..... B05B 1/28

[52] U.S. Cl. ..... 239/301; 239/600

[58] Field of Search ..... 239/290, 292, 239/296, 297, 300, 301, 394, 397, 600; 411/427

[56] References Cited

U.S. PATENT DOCUMENTS

| | | | |
|---|---|---|---|
| 1,732,691 | 10/1929 | Mueller et al. . | |
| 1,758,124 | 5/1930 | Mueller . | |
| 1,962,911 | 6/1934 | Roselund . | |
| 2,029,423 | 2/1936 | Gustafsson . | |
| 2,042,746 | 6/1936 | Tracy . | |
| 2,743,963 | 5/1956 | Peeps | 239/300 |
| 3,804,140 | 4/1974 | Harper . | |
| 4,728,039 | 3/1988 | Johnson et al. . | |
| 4,760,956 | 8/1988 | Mansfield . | |
| 4,917,300 | 4/1990 | Gloviak et al. . | |
| 5,135,172 | 8/1992 | Toth . | |
| 5,279,461 | 1/1994 | Darroch . | |
| 5,284,301 | 2/1994 | Kieffer . | |
| 5,379,910 | 1/1995 | Montgomery . | |

FOREIGN PATENT DOCUMENTS

| | | | |
|---|---|---|---|
| 736131 | 8/1955 | United Kingdom | 239/296 |

*Primary Examiner*—Andres Kashnikow
*Assistant Examiner*—Christopher S. Kim
*Attorney, Agent, or Firm*—Jones, Dy, Reavis & Pogue

[57] ABSTRACT

A retaining ring is disclosed for joining first and second flow members, The retaining ring includes a ring body having an axial passage, and securing structures for connecting the ring body to mating structures on the first flow member. An annular end is formed onto the ring body at an end of the axial passage. The annular end includes an aperture for admitting the second flow member and retaining or portion of the second flow member in conjunction with the first flow member. One or more leaf springs are formed integrally on the annular end adjacent to the aperture, for applying an axially-directed biasing force sufficient to urge first and second flow members into contact and also allow rotational indexing of the second flow member without disconnecting or loosening the ring body.

10 Claims, 3 Drawing Sheets

INDEXING AIRCAP RETAINING RING

BACKGROUND OF THE INVENTION

The present invention is directed to the field of retaining rings for removably joining two flow members. The invention has particular applicability as a retaining ring used with a spray gun system for securing a sprayer aircap to a sprayer.

Previous sprayer systems have used an indexing aircap that can change the spray between a circular pattern and a flat or "fan" pattern. This is accomplished by having different air passages within the aircap. A central air passage is included in the aircap that creates a conical airstream which atomizes the fluid from the nozzle, producing a circular atomized spray pattern. A fan pattern is created by a pair of air jets, which are formed in the aircap to point generally toward the directional axis of the central air stream. When air is injected through the airjets, the circular spray is "flattened out" so as to produce a fan pattern.

Most common aircap assembly designs have a "dial" configuration, where the aircap can be manually turned between a circular pattern position, where the air jets are blocked, and a fan pattern position, where the air jets are open. With this aircap configuration, it is necessary to secure the aircap in either respective position before spraying. In one previous design, the aircap is indexed by loosening the retaining ring, turning the cap to the desired position, and tightening the ring. This can be an awkward procedure for the end user, who must perform these steps while holding the spray gun.

In another previous design, as shown in FIG. 1, a coil spring 12 is added to the inside of the retaining ring 10 to bias the aircap 14 into sealing engagement with the spray gun assembly 16. In this way, the aircap 14 can be turned to the desired position without loosening the retaining ring 10, permitting easier operation. However, the coil spring 12 is difficult to install and easy to lose, resulting in inconvenience for the end user. Also, including the spring 12 as an extra element adds additional expense to the cost of manufacture.

SUMMARY OF THE INVENTION

In view of the disadvantages and drawbacks associated with previous devices, there is therefore a need for a retaining ring that permits easier aircap adjustment. There is also a need for an aircap and retaining ring assembly with fewer parts.

There is also a need for an aircap and retaining ring assembly that is easier and less expensive to manufacture.

These needs and others are satisfied by the retaining ring of the present invention for joining two flow members, which includes a ring body having an axial passage, and including one or more securing structures for connecting the ring body to respective mating structures on the first flow member. The retaining ring includes an annular end formed transversely to the axis onto the ring body at an end of the internal passage. The annular end includes an aperture for admitting the second flow member and retaining a portion of the second flow member in conjunction with the first flow member. The annular ring includes one or more leaf springs, formed integrally on the annular end adjacent to the aperture. These springs apply an axially-directed biasing force sufficient to maintain contact between first and second flow members and also allow rotational indexing of the second flow member without disconnecting or loosening the ring body.

As will be appreciated, the invention is capable of other and different embodiments, and its several details are capable of modifications in various respects, all without departing from the invention. Accordingly, the drawings and description are to be regarded as illustrative in nature and not restrictive.

DETAILED DESCRIPTION OF THE INVENTION

Figure 1:
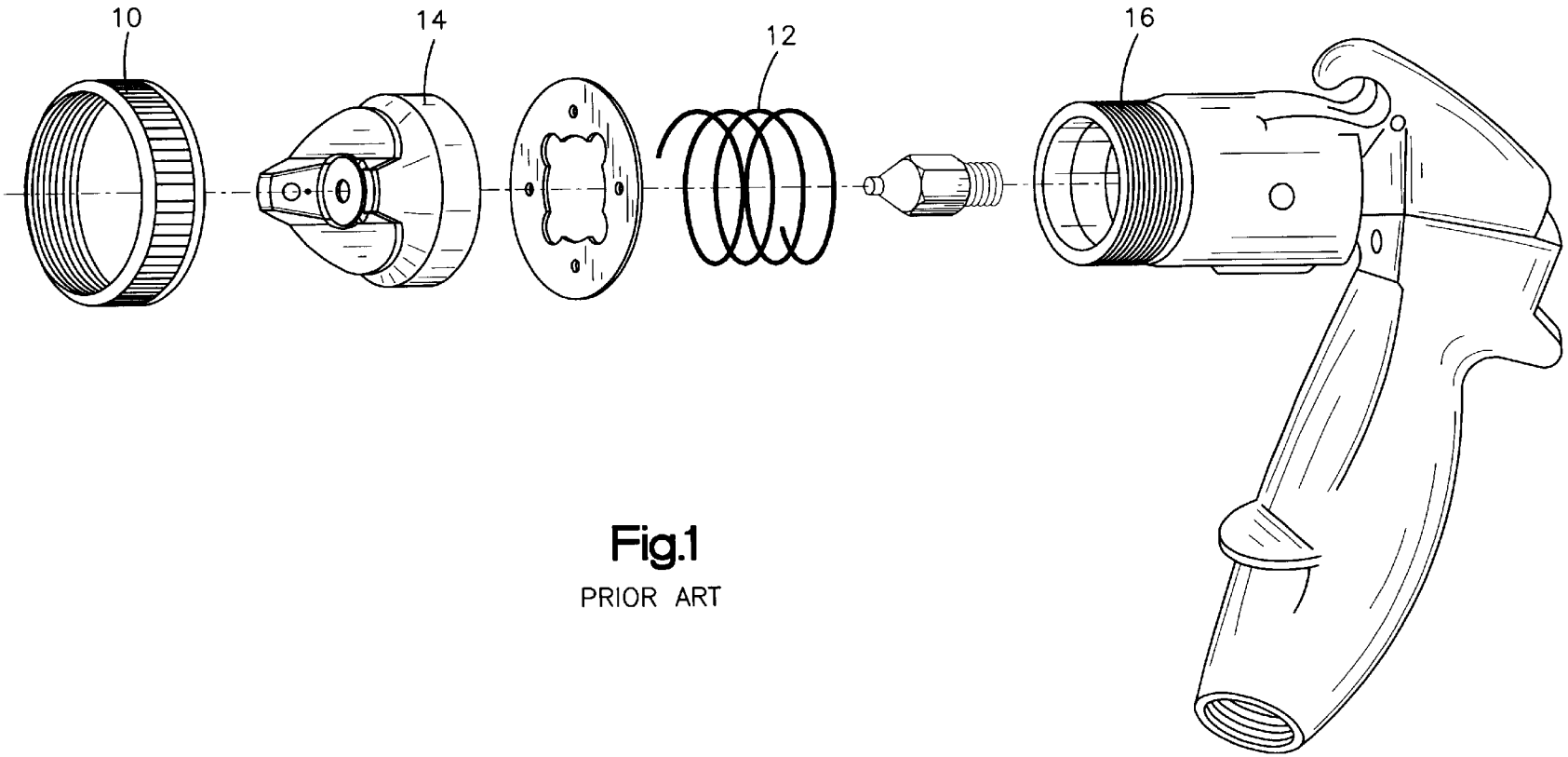
Fig.1 PRIOR ART
FIG. 1 is an exploded view showing a previous style aircap assembly.
Figure 2:
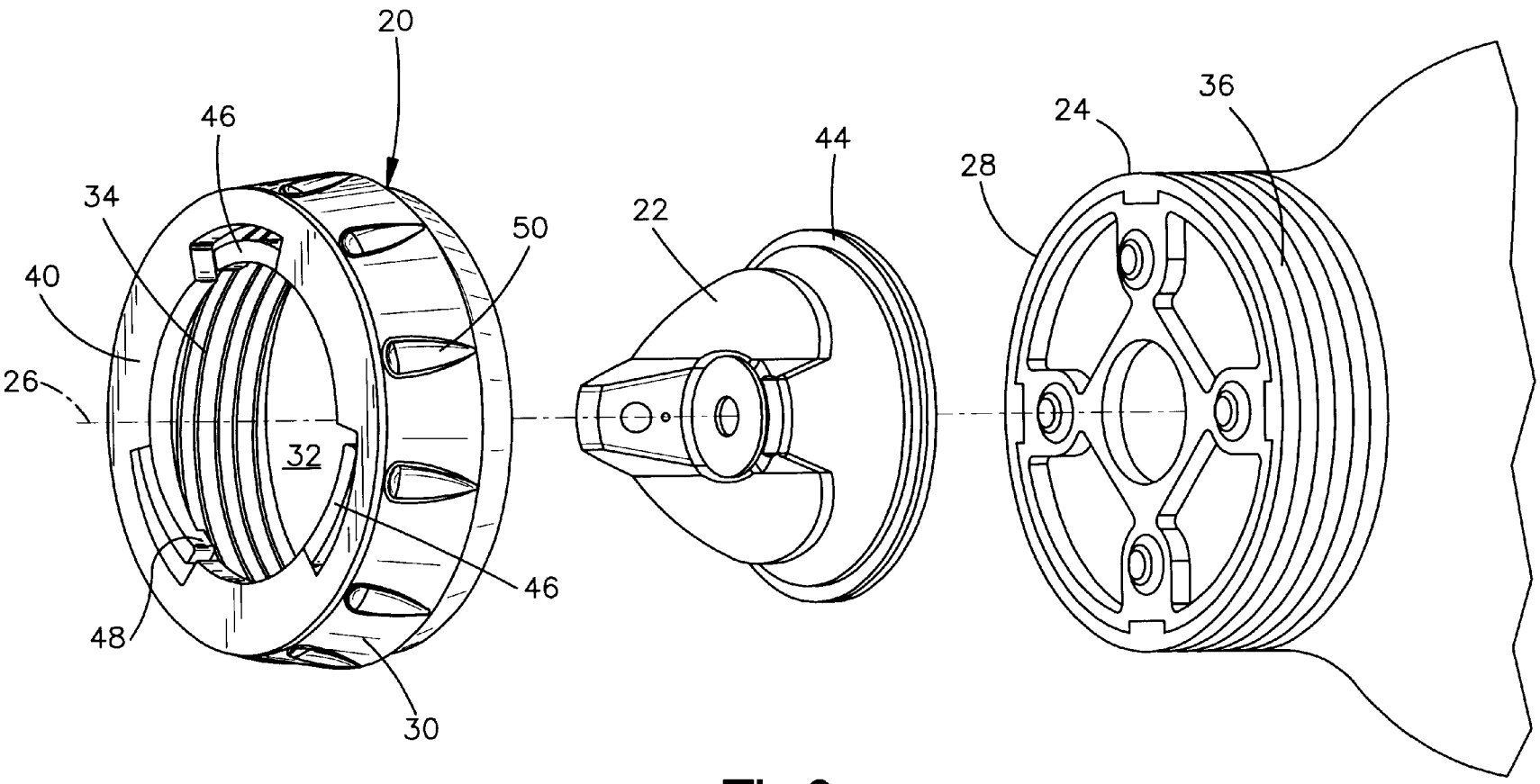
FIG. 2 is an exploded view showing an aircap assembly incorporating the retaining ring of the present invention.
Figure 3A:
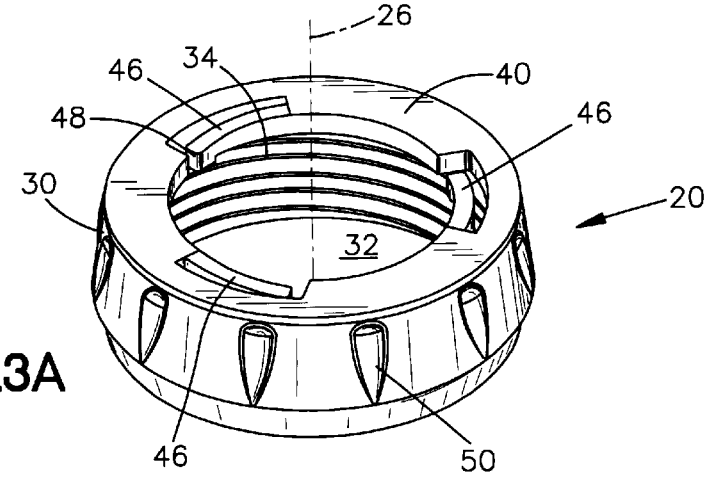
FIGS. 3A, 3B, 3C and 3D are respective oblique, frontal, side and side sectional views showing the retaining ring of the present invention.
Figure 3B:
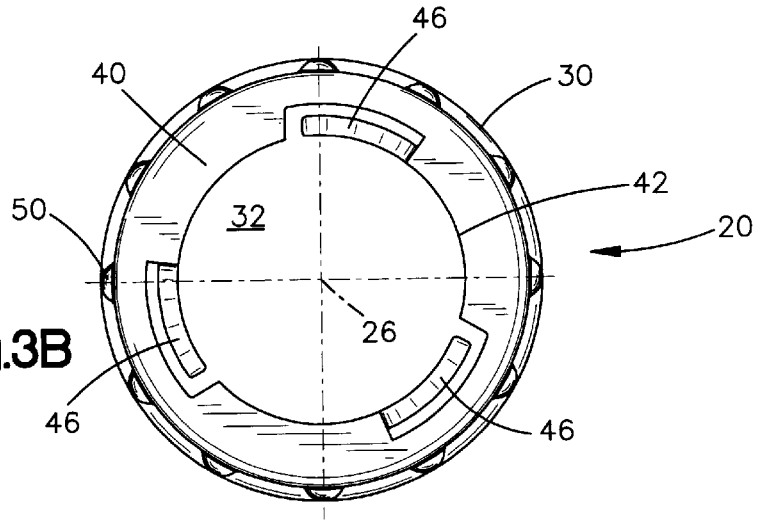
Figure 3C:
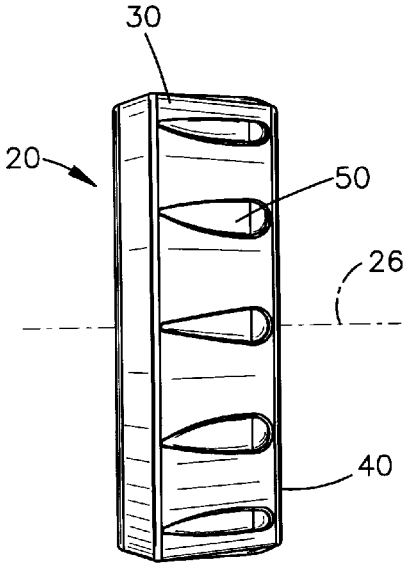
Figure 3D:
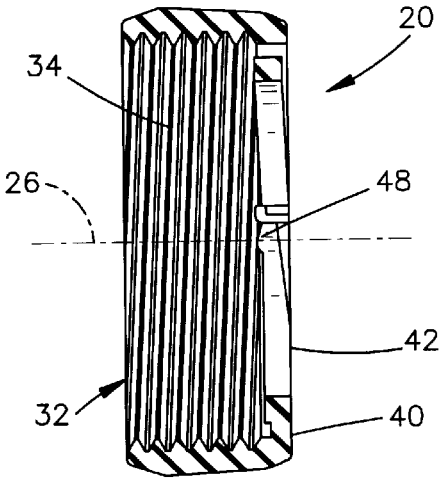

FIGS. 2 and 3A, B, C and D illustrate the retaining ring 20 of the present invention. In the preferred embodiment, the present retaining ring 20 is used to join an aircap 22 to a pressurized delivery conduit within a spray gun assembly 24. However, it should be understood that the present invention also has applicability in joining any two flow members, e.g., removable plumbing sections and the like, without departing from the invention.

The present retaining ring 20 has an axis 26, along which it assembles to the aircap 22 and spray gun assembly 24. The retaining ring 20 is defined by a ring body 30, which is preferably generally cylindrical along the axis. The ring body 30 includes an internal axial passage 32, preferably centered along the axis 26. The axial passage 32 includes one or more securing structures for connecting the ring body 30 to a corresponding mating structures on the spray gun assembly 24. In the preferred embodiment, the securing structures and mating structures are respective female and male threads 34, 36. However, it should be understood that any suitable securement, e.g., a bayonet lock, could be employed on any appropriate surfaces of the respective components, all without departing from the invention. The present spray gun assembly 24 also includes a positive stop 28 at the end for providing a predetermined spring load on the flange of the aircap 22, so that no loosening or adjustment of the aircap required by the user to rotate the aircap 22.

The present retaining ring 30 also includes an annular end 40, formed transversely to the axis 26 onto the ring body 30 at an end of the internal passage 32. The annular end 40 includes an aperture 42 for admitting the aircap 22 and retaining a portion of the aircap 22 in conjunction with the spray gun assembly 24. In the preferred embodiment, the aircap 22 includes a flange 44. The aperture 42 has a diameter smaller than that of the axial passage 32 and the flange 44, so as to retain the flange 44 when the components are assembled.

The present retaining ring also includes one or more leaf springs 46, formed integrally on the annular end 40, adjacent to the aperture 42. In the preferred embodiment as illustrated, the invention includes three leaf springs 46, but any number could be employed without departing from the invention. The present leaf springs 46 are formed along a desired arc segment of the annular end 40. The leaf springs 46 can also include a protrusion 48 for extending into the axial passage 32. When the leaf springs 46 make contact with the aircap 22, they apply an axially-directed biasing force sufficient to urge the aircap 22 and spray gun 24 into mechanical contact. The tension on the springs 40 can be adjusted by selecting appropriate dimensions of the springs 46 and materials of the retaining ring 20. However, the tension is sufficient to allow rotational indexing of the aircap 22 between a circular spray position and a fan spray position, without disconnecting or loosening the ring body 30.

The present retaining ring 30 also includes a number of gripping elements 50 to permit easy gripping while turning the ring 20. The present invention as described above permits aircap indexing without loosening the retaining ring or employing troublesome and expensive coil springs. Also, the present retaining ring is not limited to sprayer aircap applications. The present leaf springs can provide a biasing force which can provide further securement in many coupling applications where lock washers had been previously employed. Thus, the invention has applicability beyond sprayer aircaps.

As described hereinabove, the present invention solves many problems associated with previous devices and presents many improvements in efficiency and performance. However, it will be appreciated that various changes in the details, materials and arrangements of parts which have been herein described and illustrated in order to explain the nature of the invention may be made by those skilled in the art within the principle and scope of the invention as expressed by the appended claims.

I claim:

1. A retaining ring having an axis for joining first and second flow members, said retaining ring comprising:

a ring body having an axial passage, and including at least one securing structure for connecting the ring body to at least one mating structure on the first flow member;

an annular end formed transversely to the axis onto the ring body at an end of the axial passage, wherein the annular end includes an aperture for admitting the second flow member and retaining a portion of the second flow member in conjunction with the first flow member;

at least one leaf spring, formed integrally on the annular end adjacent to the aperture, for applying an axially-directed biasing force sufficient to urge first and second flow members into contact and also allow rotational indexing of the second flow member without disconnecting the ring body.

2. The retaining ring of claim 1 wherein the first flow member is a flow supply and the second flow member is a flow passage.

3. The retaining ring of claim 2 wherein the flow supply is a pressurized delivery conduit within a spray gun and wherein the flow passage is an indexing aircap.

4. The retaining ring of claim 3 wherein the aircap is rotationally indexed to vary between a circular spray position and a fan spray position.

5. The retaining ring of claim 1 wherein the axial passage is cylindrical and wherein the at least one securing structure comprises female threads formed internally within the passage, wherein the at least one mating structure comprises corresponding male threads.

6. The retaining ring of claim 1 wherein the second flow member has a flange and wherein the aperture has a diameter smaller than the axial passage, so as to retain the flange.

7. The retaining ring of clam 1 wherein the at least one leaf spring is formed along an arc segment of the annular end.

8. The retaining ring of claim 1 wherein the at least one leaf spring includes a protrusion for extending into the axial passage, for contacting the portion of the second flow member.

9. The retaining ring of claim 1 where in the at least one leaf spring comprises three leaf springs.

10. The retaining ring of claim 1 further comprising a positive stop on the first flow member for providing a predetermined spring load on the second flow member.

* * * * *